US006166702A

United States Patent [19]

Audenaerde et al.

[11] Patent Number: 6,166,702

[45] Date of Patent: Dec. 26, 2000

[54] MICROSTRIP ANTENNA

[75] Inventors: Karl R. Audenaerde; Steve Sabo, both of Wallingford; Joon Y. Lee, Hamden, all of Conn.

[73] Assignee: Radio Frequency Systems, Inc., Marlboro, N.J.

[21] Appl. No.: 09/250,387

[22] Filed: Feb. 16, 1999

[51] Int. Cl.[7] ..... H01Q 9/28

[52] U.S. Cl. ..... 343/795; 343/810

[58] Field of Search ..... 343/700 MS, 795, 343/797, 846, 848, 853, 810

[56] References Cited

U.S. PATENT DOCUMENTS

| | | | |
|---|---|---|---|
| 3,110,030 | 11/1963 | Cole, Jr. | 343/795 |
| 3,997,900 | 12/1976 | Chin et al. | 343/854 |
| 4,162,499 | 7/1979 | Jones, Jr. et al. | 343/700 MS |
| 4,204,212 | 5/1980 | Sindoris et al. | 343/700 MS |
| 4,323,900 | 4/1982 | Krall et al. | 343/700 MS |
| 4,527,163 | 7/1985 | Stanton | 343/700 MS |
| 4,758,843 | 7/1988 | Agrawal et al. | 343/795 |
| 4,816,836 | 3/1989 | Lalezari | 343/700 MS |
| 4,899,162 | 2/1990 | Bayetto et al. | 343/700 MS |
| 4,980,692 | 12/1990 | Rudish et al. | 343/700 MS |

OTHER PUBLICATIONS

"Microstrip–Array Design Principles," "Microstrip Antennas," Chapter 7, pp. 19 to 23.

*Primary Examiner*—Tan Ho

*Attorney, Agent, or Firm*—Ware, Fressola, Van Der Sluys & Adolphson LLP

[57] ABSTRACT

A microstrip antenna suitable for omnidirectional S-band operation is formed by the application of a plurality of microstrip radiating elements to the exterior surface of a dielectric tube. The microstrip radiating elements are fed by a branched microstrip input feed line connected to the elements. In the illustrated embodiment, the microstrip radiating elements are fed in-phase by feed line. A substantially cylindrical reflector tube is disposed within the dielectric tube.

19 Claims, 4 Drawing Sheets

MICROSTRIP ANTENNA

BACKGROUND OF THE INVENTION

1. Field of the Invention

The present invention generally relates to antennas. More particularly, the present invention relates to a microstrip antenna having a generally cylindrical shape.

2. Description of the Related Art

Current state of the art omnidirectional S-band radio frequency antennas (2.1–2.7 GHz) are made from a large number of machined parts. Such parts must be assembled and tuned. Because significant time is needed for machining, assembly and tuning of each antenna, the cost of manufacturing such antennas is relatively high. Also, because such antennas are fabricated from a large number of assembled parts, these antennas may be easily damaged by the wind and other elements of nature. Periodically, the machined components forming such antennas may need to be adjusted or reassembled so as to ensure that these antennas are properly tuned.

SUMMARY OF THE INVENTION

It is a primary object of the present invention to provide a radio frequency microstrip antenna that is inexpensive to manufacture, is reliable and is durable.

It is another object of the present invention to provide an omnidirectional S-band radio frequency antenna which is easy to manufacture, reliable and durable.

In accordance with the present invention, the foregoing primary objective is realized by providing an antenna comprising a substantially cylindrical dielectric tube, a dipole microstrip radiating element formed on the dielectric tube, a microstrip input feed means connected to poles of the microstrip dipole radiating element for driving the poles thereof, and a substantially cylindrical reflector tube disposed within the dielectric tube.

Other objects and advantages of the invention will be apparent from the following detailed description and the accompanying drawings.

BRIEF DESCRIPTION OF THE DRAWINGS

The drawings, not drawn to scale, include.

DETAILED DESCRIPTION OF THE PRESENT INVENTION

Figure 1:
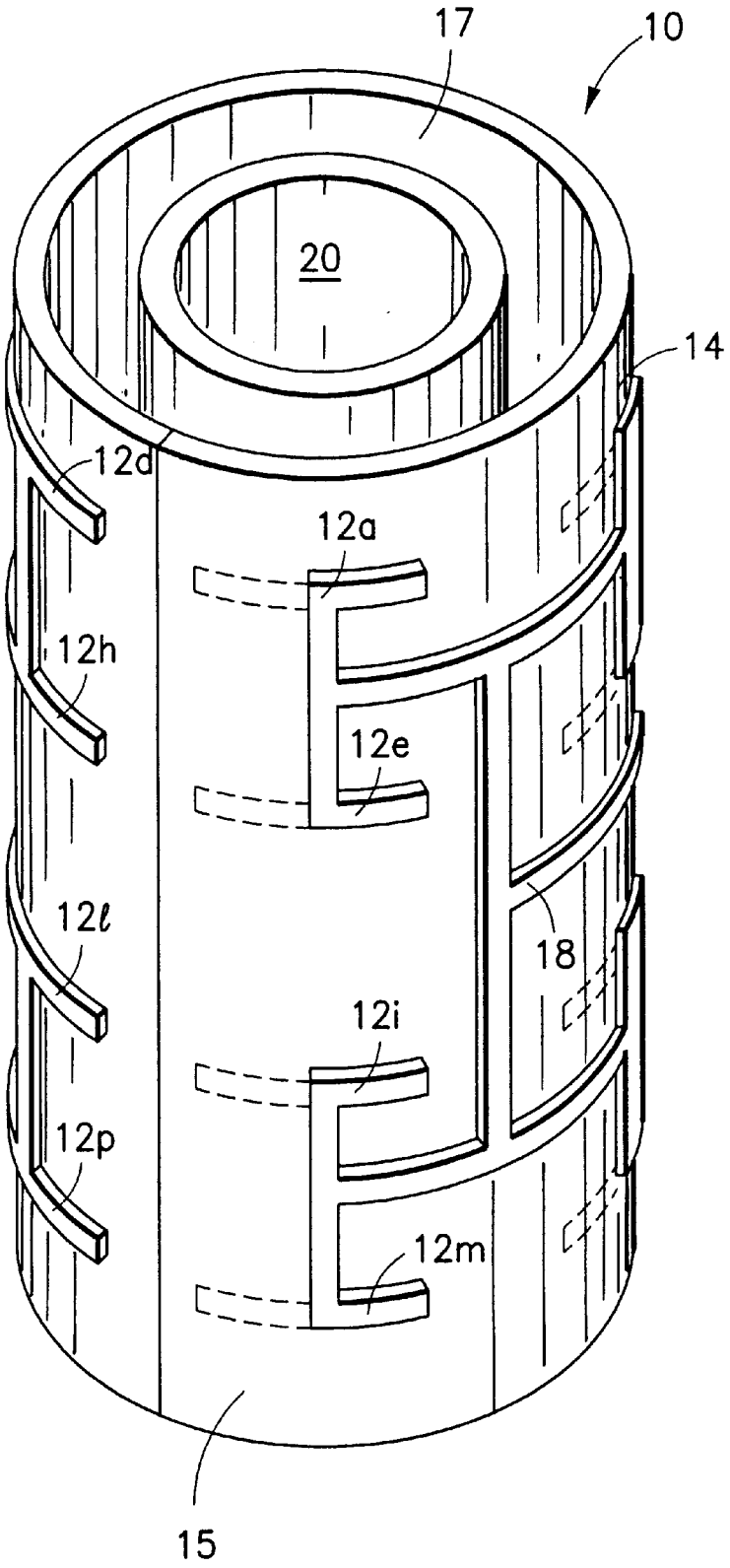
FIG. 1 which is an isometric view of a microstrip antenna made according to the present invention.

Referring generally to the drawings, there is shown a microstrip antenna 10 made according to the present invention. The antenna 10 is formed by providing one and preferably a plurality of dipole microstrip radiating elements 12*a*–12*p* on a substantially cylindrical dielectric tube 14. The dielectric tube 14 may made with any dielectric material, and preferably, the tube 14 is formed out of polytetrafluoroethylene. The tube 14 has an exterior substantially cylindrical surface 15 and an interior substantially cylindrical surface 17. The thickness of the tube 14 is in the range of about 0.003 to 0.05 $\lambda_0$. At S-band radio frequencies (2.1 to 2.7 Ghz), $\lambda_0$ is typically in the range of about 11 to 14 cm.

Figure 2:
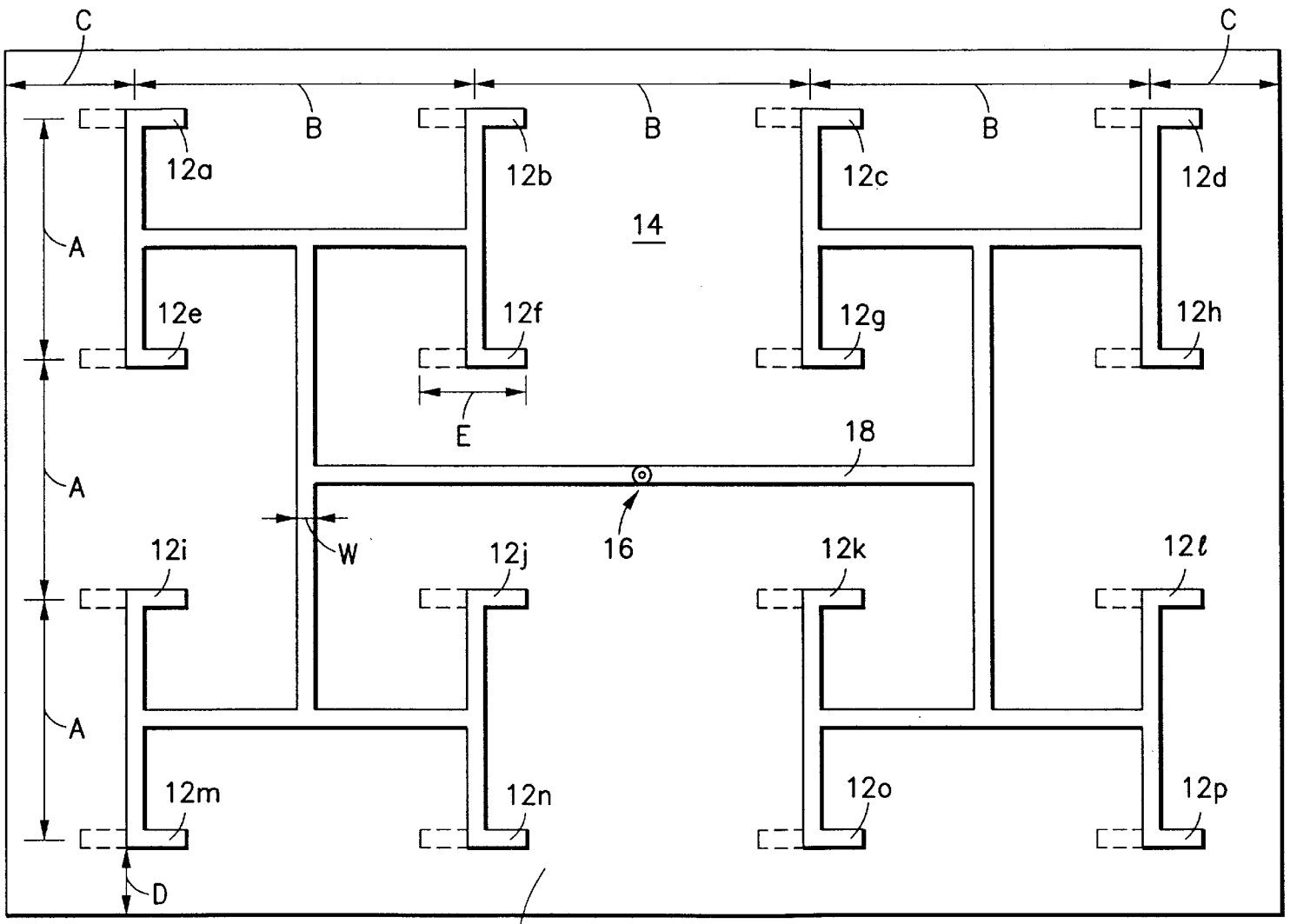
FIG. 2 which is a plan view of an array of dipole radiating elements formed on the dielectric tube.
Figure 3:
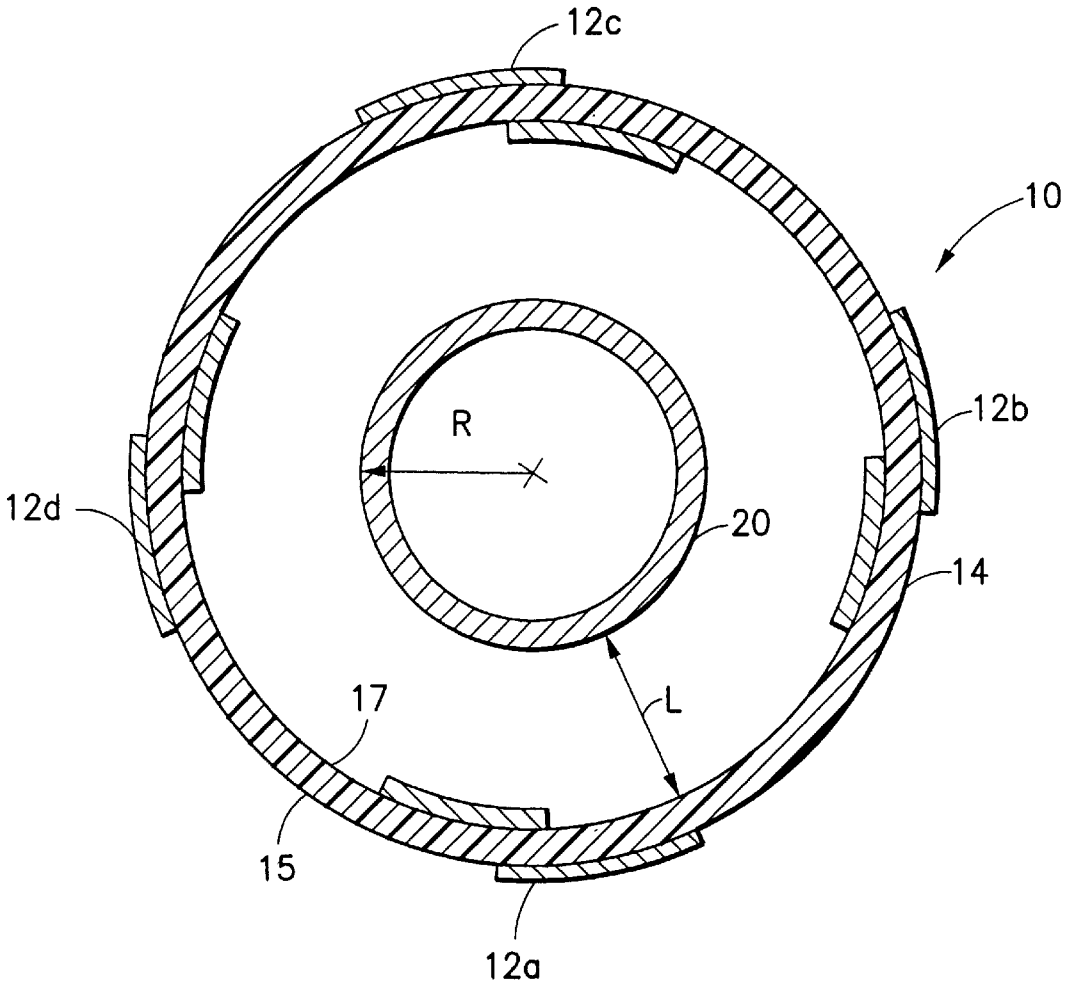
FIG. 3 which is a cross-sectional view of the microstrip antenna taken through a row of radiating elements.

As illustrated in the isometric view of FIG. 1 and the plan view of FIG. 2, the microstrip dipole radiating elements 12*a*–12*p* of the plurality are distributed about the tube 14 in an array of N circumferentially distributed columns and M axially distributed rows. In the exemplary embodiment shown in the FIGS., there are four columns and four rows of dipole radiating elements. The N columns of microstrip dipole radiating elements are evenly distributed about the tube 14 so as to provide a substantially omnidirectional radiation pattern. The spacing B between the dipole elements in each of the N circumferentially distributed columns is 0.9 $\lambda_0$, where $\lambda_0$ is the fee space wavelength. The spacing A between the dipole elements in each of the M axially distributed rows is 0.7 $\lambda_g$, where $\lambda_g$ is the guided wavelength (wavelength in dielectric). $\lambda_g$ is equal to $\lambda_0/\epsilon_r$. This spacing or distribution is maintained regardless of the number of dipole radiating elements chosen to form the array. In other words, if the array comprises 8 columns by 8 rows, the aforementioned spacing between the radiating elements still applies. Of course, those skilled in the art will now appreciate that the diameter of the dielectric tube 14 will increase to accommodate such spacing.

Preferably, the length E of each of the dipole radiating elements is 0.50 $\lambda_g$. While the dipole radiating elements 12*a*–12*p* are illustrated as having a substantially rectangular or linear geometry, such elements may be provided with other suitable shapes such as those having a substantially triangular geometry and those with a log periodic geometry.

Each of the microstrip dipole radiating elements 12*a*–12*p* is connected to a coaxial input 16 via a parallel microstrip feed line network 18 which branches out from the coaxial input 16. As illustrated in the plan view, the length of the legs of feed line network between the coaxial input 16 and each of the dipole elements is the same so that the dipole elements 12*a*–12*p* are thereby driven in-phase with each other. Those skilled in the art will appreciate that the length may be adjusted to provide a desired vertical pattern. The width W of the microstrip feed line network depends upon the dielectric constant and material thickness of the dielectric tube. The width W may be adjusted to provide impedance matching for the dipole elements 12*a*–12*p*. Typically, the width W will be on the order of about 0.5 to 1 cm.

Figure 4:
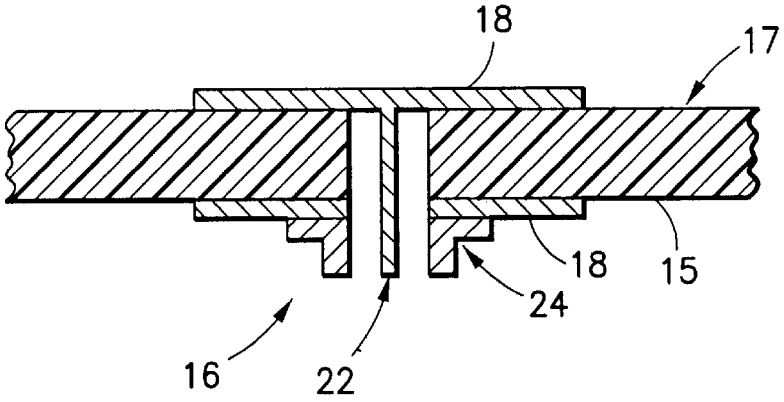
FIG. 4, which is a cross-sectional view of a coaxial feed input.

In the exemplary embodiment illustrated in the FIGS., one of the poles of each of the microstrip dipole radiation elements 12*a*–12*p* is formed on the exterior substantially cylindrical surface 15 of the dielectric tube 14. The other poles of each of the microstrip dipole radiation elements 12*a*–12*p* are formed on the interior cylindrical surface 17 of the dielectric tube 14. In this arrangement, the microstrip feed line network 18 is formed on both the interior and exterior substantially cylindrical surfaces of the tube 14. As illustrated in FIG. 4, the center conductor 22 of the coaxial input 16 is connected to the part of the feed line network 18 applied to the interior substantially cylindrical surface while the outer conductor 24 is connected to the part of the feed line network 18 applied to the exterior substantially cylindrical surface of the tube 14.

According to the present invention, a substantially cylindrical reflector tube 20 made from a conductive material, such as aluminum, is disposed within the dielectric tube 14.

Preferably, the reflector tube 20 is disposed within the dielectric tube 14 so as to be concentric thereto. Also, the reflector tube 20 preferably has an outer radius R of 0.35 $\lambda_0$ and the length L of the space between the interior cylindrical surface 17 of the dielectric tube 14 and the outer radius R of the reflector is 0.25 $\lambda_0$. The wall thickness of tube 20 needs to be large enough to provide mechanical stability.

Figure 5:
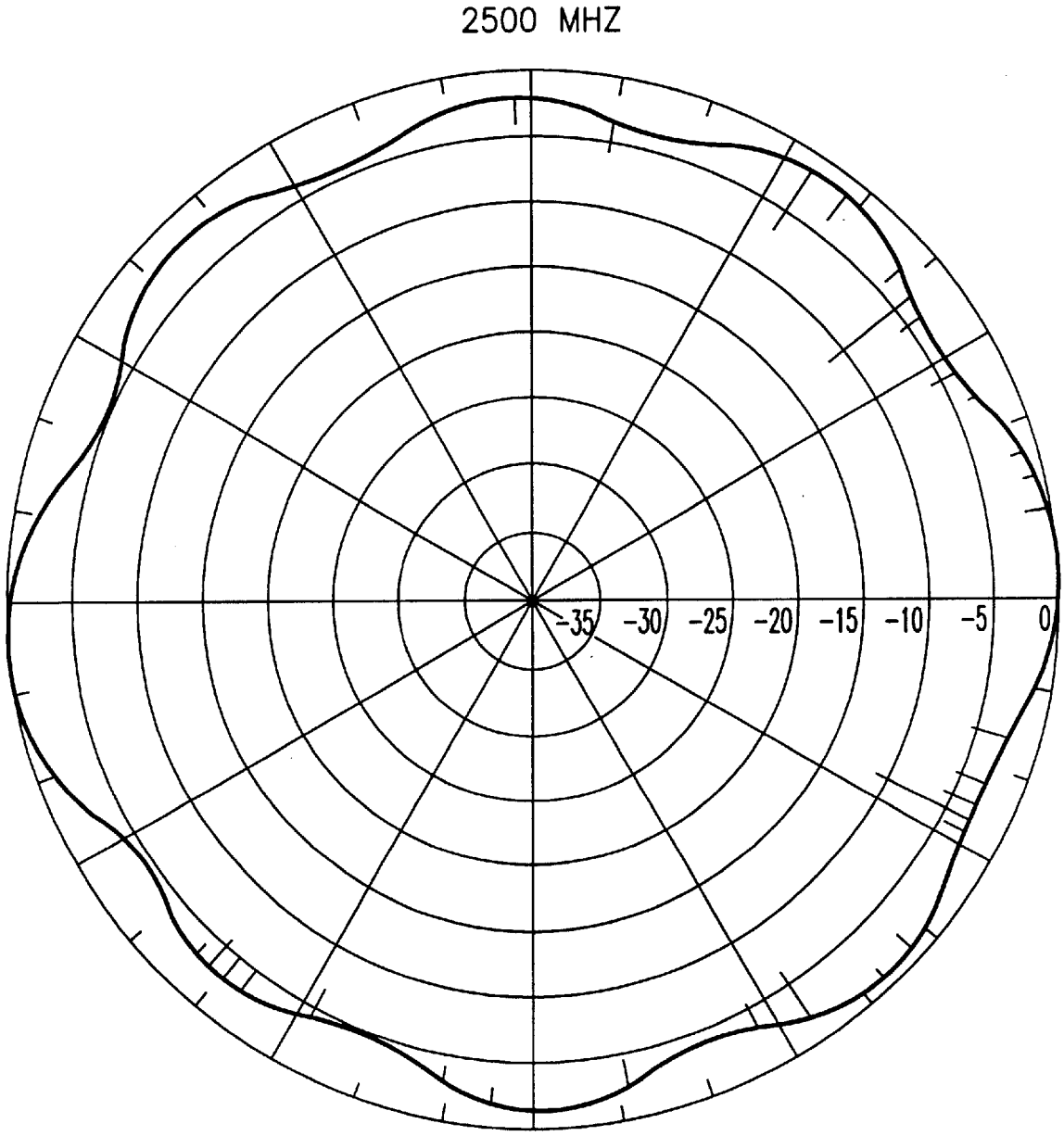
FIG. 5, which is a graph illustrating the radiation pattern produced by the exemplary embodiment illustrated in FIGS. 1 through 3.

When driven at 2.5 Ghz, the exemplary embodiment of the antenna 10 produces a radiation pattern as illustrated in FIG. 5. As shown, the radiation pattern is substantially omnidirectional.

The antenna 10 as described above may be made using the same relatively inexpensive methods for making a printed circuit on a printed circuit board. For example, a sheet of dielectric material, such as polytetrafluoroethylene, is coated with an etchable conductive material, such as copper, on both sides. The conductive material on the sheet is coated with a photoreactive masking agent. The photoreactive masking agent is irradiated with light through a photonegative tool having a suitable pattern of microstrip dipole radiating elements and feed line network thereon, such as the 4 by 4 array, for example. The irradiated sheet is then exposed to an etching solution to etch away the unprotected conductive material that was exposed to the light, i.e., that which was not masked by the photonegative tool. After etching, only the radiating elements 12*a*–12*p* and feed line network 18 formed of the conductive material remain and the resulting product is substantially as illustrated in FIG. 2. Those skilled in the art will now appreciate that as an alternative to etching a flat sheet as described above, a dielectric tube formed from polytetrafluoroethylene (Teflon) or other suitable material can be machined to the proper dimension and then convention etching processes can be applied to the tube.

The sheet with radiating elements 12*a*–12*p* and feed line network 18 thereon is rolled into the tube 14 and its adjacent edges are held or joined together. The reflective tube 20 may then be disposed within the dielectric tube 14 to form the antenna. The coaxial connector, such as 16, is attached to the feed line network 18 to provide a signal thereto.

As can be seen from the foregoing detailed description and drawings, the present invention provides an inexpensive, reliable, and durable omnidirectional antenna for S-band radio frequency and other frequency applications. Although the antenna has been described with respect to one or more particular embodiments, it will be understood that other embodiments of the present invention may be employed without departing from the spirit and scope of the present invention. Hence, the present invention is deemed limited only by the appended claims and the reasonable interpretation thereof.

What is claimed is:

1. An antenna comprising:

a substantially cylindrical dielectric tube having internal and external cylindrical surfaces;

a dipole microstrip radiating element formed on both the internal and external cylindrical surfaces of the dielectric tube;

a microstrip input feed means connected to poles of the microstrip dipole radiating element for driving the poles thereof; and a substantially cylindrical reflector tube disposed within the dielectric tube and being concentrically arranged at a distance L from an internal cylindrical surface of the substantially cylindrical dielectric tube.

2. The antenna of claim 1, wherein the dielectric tube includes interior and exterior cylindrical surfaces, wherein one pole of the microstrip dipole radiating element is formed on the exterior cylindrical surface of the dielectric tube, wherein the other pole of the microstrip dipole radiating element is formed on the interior cylindrical surface of the dielectric tube, and wherein the input feed means connected to the poles is formed on the interior and exterior surfaces of the dielectric tube.

3. The antenna of claim 1, wherein the reflector tube is concentrically disposed within the dielectric tube.

4. The antenna of claim 1, wherein the reflector tube is formed from a conductive material.

5. The antenna of claim 1, wherein the conductive material is aluminum.

6. The antenna of claim 1, wherein the dielectric tube is formed from polytetrafluorethylene.

7. An antenna comprising:

a substantially cylindrical dielectric tube having internal and external cylindrical surfaces;

a plurality of dipole microstrip radiating elements formed on both the internal and external cylindrical surfaces of the dielectric tube and distributed about the tube so as to provide a substantially omnidirectional radiation pattern;

a microstrip input feed means connected to the poles of each of the microstrip dipole radiating elements for driving the poles thereof; and a substantially cylindrical reflector tube disposed within the dielectric tube, having a radius R, and being concentrically arranged at a distance L from an internal cylindrical surface of the substantially cylindrical dielectric tube.

8. The antenna of claim 7, wherein the dielectric tube includes interior and exterior cylindrical surfaces, wherein one pole of the microstrip dipole radiating elements is formed on the exterior cylindrical surface of the dielectric tube, wherein the other pole of the microstrip dipole radiating elements is formed on the interior cylindrical surface of the dielectric tube, and wherein the input feed means connected to the poles is formed on the interior and exterior surfaces of the dielectric tube.

9. The antenna of claim 7, wherein the input feed means connected to the poles is formed so as to feed each of the dipole radiating elements in-phase.

10. The antenna of claim 7, wherein the reflector tube is concentrically disposed within the dielectric tube.

11. The antenna of claim 7, wherein the reflector tube is formed from aluminum.

12. The antenna of claim 7, wherein the dielectric tube is formed from polytetrafluoroethylene.

13. The antenna of claim 7, wherein the plurality of dipole elements are further distributed on the dielectric tube into an array of N circumferentially distributed columns and M axially distributed rows.

14. The antenna of claim 13, where N is four and M is four.

15. The antenna of claim 13, wherein spacing between the dipole elements in each of the axially distributed rows is 0.7 $\lambda_g$ and spacing between the dipole elements in each of the circumferentially distributed columns is 0.9 $\lambda_0$.

16. The antenna of claim 15, wherein the length of each of the microstrip dipole elements is 0.5 $\lambda_g$.

17. The antenna of claim 15, wherein the reflector is concentrically disposed within the dielectric tube, wherein the reflector has an outer radius of 0.35 $\lambda_0$ and wherein the length of space between the inner surface of the dielectric tube and the outer radius of the reflector is 0.25 $\lambda_0$.

18. An antenna comprising:

a substantially cylindrical dielectric tube having internal and external cylindrical surfaces;

a plurality of dipole microstrip radiating elements formed on both the internal and external cylindrical surfaces of the dielectric tube and distributed about the tube in an array of N circumferentially distributed columns and axially distributed rows so as to provide a substantially omnidirectional radiation pattern;

a microstrip input feed means connected to the poles of each of the microstrip dipole radiating elements for driving the poles thereof in-phase; and a substantially cylindrical reflector tube made from a conductive material concentrically disposed within the dielectric tube, having a radius R and being concentrically arranged at a distance L from an internal cylindrical surface of the substantially cylindrical dielectric tube.

19. The antenna of claim 18, wherein spacing between the dipole elements in each of the axially distributed rows is 0.7 $\lambda_g$, wherein spacing between the dipole elements in each of the circumferentially distributed columns is 0.9 $\lambda_0$, wherein the length of each of the microstrip dipole elements is 0.5 $\lambda_g$, wherein the reflector has an outer radius of 0.35 $\lambda_0$, and wherein the length of space between the inner surface of the dielectric tube and the outer radius of the reflector is 0.25 $\lambda_0$.

* * * * *